US005150089A

United States Patent [19]

Komazaki et al.

[11] Patent Number: 5,150,089

[45] Date of Patent: Sep. 22, 1992

[54] DIELECTRIC FILTER HAVING AN ATTENUATION POLE TUNABLE TO A PREDETERMINED FREQUENCY

[75] Inventors: Tomokazu Komazaki; Katsuhiko Gunji; Norio Onishi; Akira Mashimo, all of Tokyo, Japan

[73] Assignee: Oki Electric Industry Co., Ltd., Tokyo, Japan

[21] Appl. No.: 641,252

[22] Filed: Dec. 26, 1990

Related U.S. Application Data

[63] Continuation of Ser. No. 423,034, Oct. 18, 1989, abandoned.

[30] Foreign Application Priority Data

Oct. 18, 1988 [JP] Japan ..... 63-260440

[51] Int. Cl.[5] ..... H01P 1/202; H01P 1/205

[52] U.S. Cl. ..... 333/206; 333/207

[58] Field of Search ..... 333/202, 204–207, 333/222, 223, 219, 235

[56] References Cited

U.S. PATENT DOCUMENTS

| | | | |
|---|---|---|---|
| 4,716,391 | 12/1987 | Moutrie et al. | 333/206 |
| 4,768,003 | 8/1988 | Kawakami et al. | 333/202 |
| 4,855,693 | 8/1989 | Matsukura et al. | 333/223 X |
| 4,890,079 | 12/1989 | Sasaki | 333/202 X |
| 4,965,537 | 10/1990 | Kommrusch | 333/202 |
| 4,987,393 | 1/1991 | Yorita et al. | 333/202 |

FOREIGN PATENT DOCUMENTS

| | | | |
|---|---|---|---|
| 0112101 | 7/1982 | Japan | 333/202 |
| 60-254802 | 12/1985 | Japan . | |
| 0254802 | 12/1985 | Japan | 333/202 |
| 0054803 | 3/1988 | Japan | 333/206 |
| 0054804 | 3/1988 | Japan | 333/206 |
| 0124601 | 5/1988 | Japan | 333/206 |
| 0053603 | 3/1989 | Japan | 333/202 |
| 1-173904 | 7/1989 | Japan . | |
| WO83/02853 | 8/1983 | PCT Int'l Appl. . | |
| 2163606A | 2/1986 | United Kingdom . | |
| 2165098A | 4/1986 | United Kingdom . | |

*Primary Examiner*—Eugene R. LaRoche
*Assistant Examiner*—Seung Ham
*Attorney, Agent, or Firm*—Wenderoth, Lind & Ponack

[57] ABSTRACT

A dielectric filter includes a homogeneous monolithic block of dielectric material having a plurality of parallel extending dielectric resonators formed therein. A plurality of first electrodes extend alond the top surface of the monolithic block, each encompassing an opening in the monolithic block defined by a corresponding one of the plurality of dielectric resonators. Either the distance between adjacent dielectric resonators or the configuration of the first electrodes is established to cause an overcoupling based on the coupling impedance, thereby tuning an attenuation pole of the dielectric filter to a finite frequency. Additionally, second electrodes are provided along the top surface of the monolithic block extending between and spaced from the first electrodes and connected to a ground electrode.

1 Claim, 10 Drawing Sheets o:L = 6.5 (mm)
x:L = 5.5 (mm)
•:L = 4.5 (mm)
ATTENUATION dB (dB)
0
10
20
30
40
795
805
815
825
835
845
855
865
875
885
FREQUENCY f (MHz)

DIELECTRIC FILTER HAVING AN ATTENUATION POLE TUNABLE TO A PREDETERMINED FREQUENCY

This application is a continuation of now abandoned application, Ser. No. 07/423,034 filed on Oct. 18, 1989.

BACKGROUND OF THE INVENTION

1. Field of the Invention

The present invention generally relates to a dielectric filter applicable to an antenna duplexer of a car telephone and, more particularly, to a dielectric filter having an attenuation pole which is tunable to a predetermined frequency.

2. Description of the Prior Art

A dielectric filter customarily has a plurality of dielectric resonators implemented by center electrodes which may be arranged substantially parallel to each other in a homogeneous monolithic block of dielectric material. The dielectric block is provided with an input electrode pattern and an output electrode pattern thereon. The dielectric resonators in combination constitute a series resonance circuit and define a pass band frequency of the filter.

A conductive electrode pattern for frequency adjustment is provided on one surface of the dielectric block and connected to one end of each center conductor. Another conductive electrode pattern is provided on the above-mentioned surface of the dielectric block in such a manner as to intervene between nearby dielectric resonators for the purpose of adjusting coupling capacitance or coupling inductance. A metalized pattern is formed on opposite sides and bottom of the dielectric block and connected to ground.

An insulated wire having an insulative coating is laid above the dielectric resonators and connected at one end to the metalized pattern and at the other end to the output electrode pattern. The insulated wire may be implemented as an ICXL-PVC wire having a diameter of 0.32 millimeter, for example. An ICXL-PVC wire is a wire having a single conductor and a coating of vinyl chloride, as is well known in the art. Such an insulated wire has the following effect in the electrical aspect.

The ICXL-PVC wire is connected to the output electrode pattern and spaced apart from the dielectric resonators of the dielectric filter by a predetermined distance. Since the dielectric resonators serve as $\lambda/4$ semicoaxial resonators, the electric field is most intensive at their open end. A certain capacitance exists between the dielectric resonators and the ICXL-PVC wire which is spaced apart from the open end of the dielectric resonators, setting up a capacitive coupling. In this kind of dielectric filter, therefore, a parallel resonance circuit is completed by the coupling capacitance between the ICXL-PVC wire and the dielectric resonators, self-inductances of the ICXL-PVC wire, coupling capacitance between the input electrode pattern and the dielectric resonator, coupling capacitance between the dielectric resonators themselves, and coupling capacitance between the dielectric resonators and the output electrode pattern. The resonance frequency of the parallel resonance circuit is the zero transmission point, i.e., infinite attenuation point or attenuation pole. The parallel resonance circuit made up of the $\lambda/4$ semicoaxial resonators defines a pass band.

The prior art dielectric filter having the above construction has some problems left unsolved. Specifically, the use of an ICXL-PVC wire for achieving an attenuation pole makes it difficult to tune the attenuation pole to a predetermined frequency range. While the ICXL-PVC wire has to be surely fixed to the dielectric block in order to set up an accurate attenuation pole, the fixation is not easy and, therefore, the reliability of operation is not satisfactory. This, coupled with the poor tunability of the pole, adds to the cost involved in the fabrication of a high performance polar dielectric filter.

SUMMARY OF THE INVENTION

It is therefore an object of the present invention to provide a high performance and inexpensive dielectric filter the attenuation characteristic of which is attained by changing the distance or pitch of dielectric resonators or the configuration of electrodes.

A dielectric filter of the present invention has a homogenous monolithic block of dielectric material. A plurality of dielectric resonators have individual center conductors which are formed in the block of dielectric material substantially in parallel with each other. A plurality of conductive electrodes for adjustment are arranged on one side of the block of dielectric material, and each extends across one end of respective one of the center conductors. Either one of the distance between nearby ones of the dielectric resonators and the configuration of the electrodes for adjustment is changed to cause overcoupling on the basis of coupling inductance or coupling capacitance, whereby an attenuation pole of the dielectric filter is tuned to an infinite frequency.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1A:
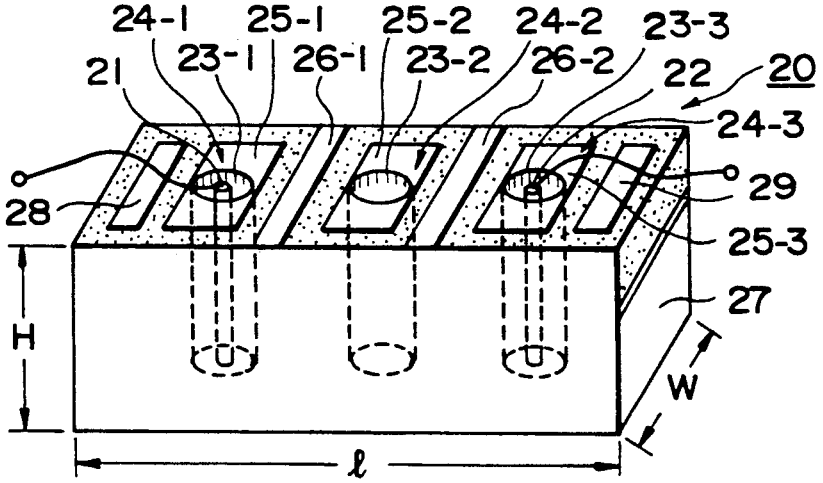
FIGS. 1A, 1B and 1C are respectively a perspective view, a top plan view, and a sectional side elevation showing a dielectric filter embodying the present invention.
Figure 1B:
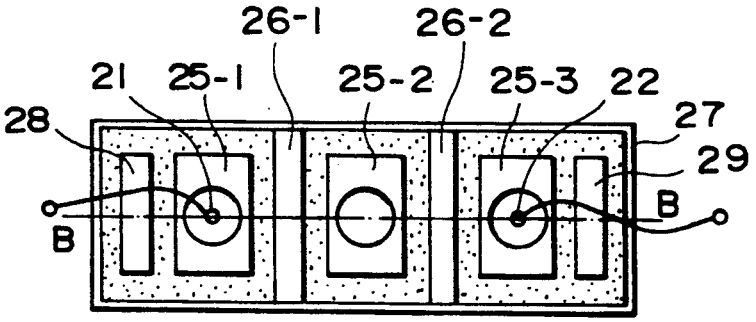
Figure 1C:
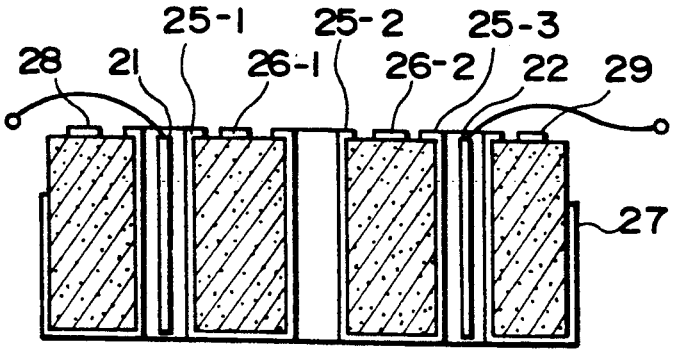

Referring to FIGS. 1A to 1C, a polar dielectric filter embodying the present invention is shown which has three consecutive stages by way of example. As shown, the dielectric filter has a dielectric body 20 which is configured in a rectangular parallelepiped. The dielectric body 20 has a width W, a length l and a height H which may be 6.0 millimeters, 20.0 millimeters, and 8.8 millimeters, respectively. The dielectric body 20 is implemented as a homogeneous monolithic block of dielectric material. An input pin 21 and an output pin 22 each being made of a conductive material are disposed in the dielectric block 20 and extend to the upper end of the latter. A plurality of center conductors, three center conductors 23-1, 23-2 and 23-3 in the illustrative embodiment, are arranged substantially parallel to each other within the dielectric block 20, constituting dielectric resonators 24-1, 24-2 and 24-3. Conductive electrodes for frequency adjustment 25-1, 25-2 and 25-3 are provided on one side of the dielectric body 20, and each extends across respective one of the center conductors 23-1, 23-2 and 23-3. Electrodes 26-1 and 26-2 are interposed between the dielectric resonators 24-1 and 24-2 and between the dielectric resonators 24-2 and 24-3, respectively, each for adjusting coupling impedance. A metalized layer 27 is formed on the front and rear ends, right and left sides and bottom of the dielectric body 20 and is connected to ground. A pair of electrodes 28 and 29 are positioned outwardly of the electrodes 25-1 and 25-3 with respect to the lengthwise direction of the dielectric body 20, serving to adjust the coupling capacitance.

In operation, an electric signal applied to the input pin 21 causes the dielectric resonator 24-1 to generate an electromagnetic field. This electromagnetic field is transferred to the dielectric resonator 24-2 via the electrode 26-1 which is adapted for the adjustment of coupling impedance. Further, the electromagnetic field which reached the dielectric resonator 24-2 is imparted to the dielectric resonator 24-3 via the electrode 26-2 with coupling inductance being adjusted by the electrode 26-2. Consequently, an electric signal is fed to a load which is connected to the output pin 22.

Figure 2:
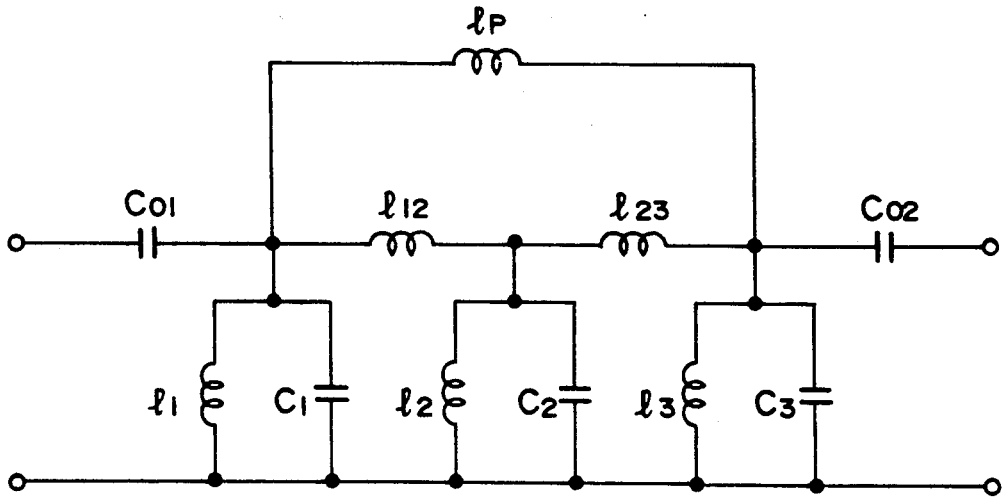
FIG. 2 is a diagram showing a lumped constant equivalent circuit representative of the embodiment shown in FIGS. 1A to 1C.

Referring to FIG. 2, an equivalent circuit representative of lumped constants which are included in the dielectric filter of FIGS. 1A to 1C is shown. In FIG. 2, the equivalent LCs (inductance-capacitances) of the dielectric resonators 24-1, 24-2 and 24-3 are represented by ($l_1C_1$), ($l_2C_2$) and ($l_3C_3$), respectively. The coupling capacitance between the input pin 21 and the associated dielectric resonator 24-1 and the coupling capacitance between the output pin 22 and the associated dielectric resonator 24-3 are labeled $C_{01}$ and $C_{02}$, respectively. The coupling inductance developed by the adjusting electrode 26-1 and dielectric body 20 intervening between the successive dielectric resonators 24-1 and 24-2 is represented by $l_{12}$. Likewise, the coupling inductance developed by the adjusting electrode 26-2 and dielectric body 20 intervening between the successive dielectric resonators 24-2 and 24-3 is represented by $l_{23}$. Further, the coupling inductance between the dielectric resonators 24-1 and 24-3 located at the input and output stages, respectively, is labeled $l_p$. Due to the coupling inductance $l_p$, overcoupling occurs to produce a frequency $f_\infty$ which provides infinite attenuation, i.e., an attenuation pole in the high-frequency attenuation range of the pass band. Specifically, the frequency $f_\infty$ is produced by:

$$S[l_p+l_{12}+l_{23}+(l_{12}l_{23})/l_0]+S^3l_{12}l_{23}C_0=0 \quad (1)$$

where s is equal to $j\omega$; and $$\omega_\infty^2=(1/l_0C_0)\{(l_0l_p)/(l_{12}l_{23})+(l_0/l_{23})+(l_0/l_{12})+1\} \quad (2)$$

where $\omega_\infty$ is equal to $2\pi f_\infty$.

From the above equation (2), it will be seen that the frequency $f_\infty$ exists due to the existence of the coupling inductance $l_p$ and occurs at the higher frequency side than the pass band. The frequency $f_\infty$, therefore, depends on the value of the coupling inductance $l_p$. The coupling inductance $l_p$ can be set at any desired value and adjusted with ease by changing the pitch or distance of the dielectric resonators 24-1, 24-2 and 24-3 or the configuration of the electrodes 25-1, 25-2 and 25-3, as will be described.

Figure 3A:
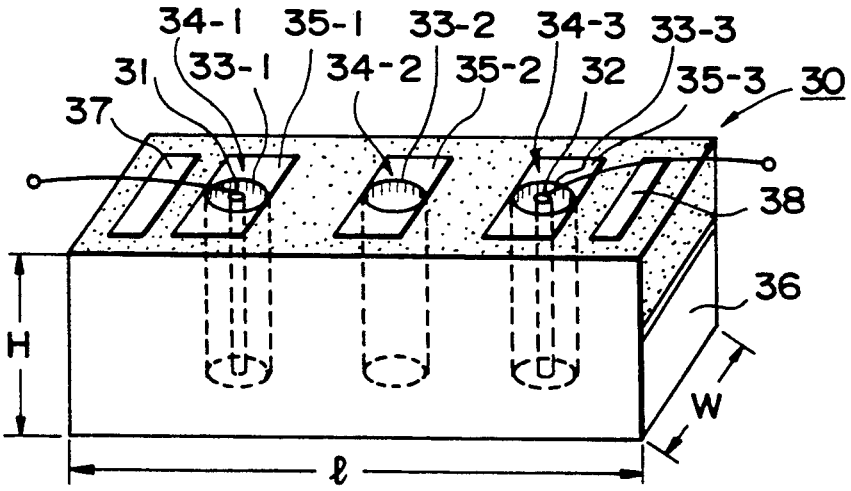
FIGS. 3A, 3B and 3C are views similar to FIGS. 1A, 1B and 1C, respectively, showing an alternative embodiment of the present invention.
Figure 3B:
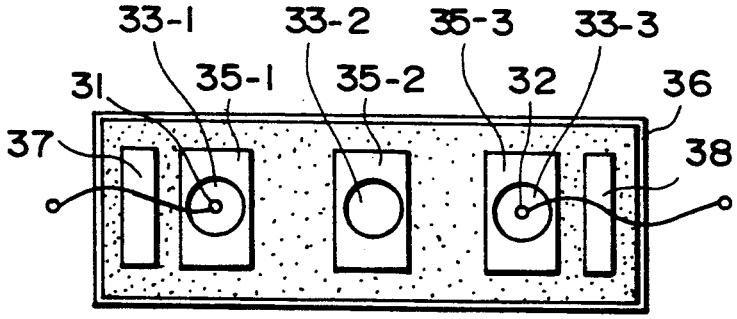
Figure 3C:
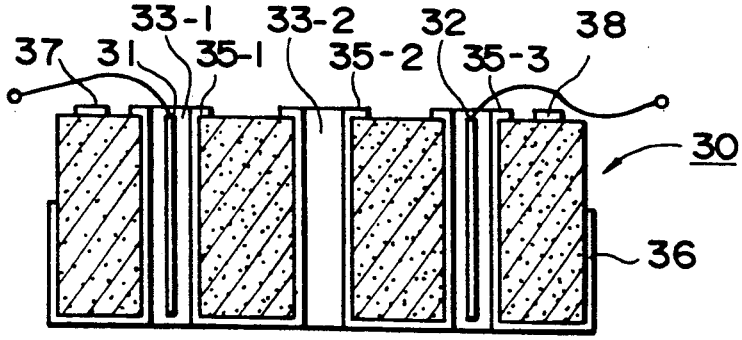

Referring to FIGS. 3A to 3C, an alternative embodiment of the present invention is shown which is also provided with three consecutive filter stages. The dielectric filter shown in FIGS. 3A to 3C has a dielectric body 30 which is configured in a rectangular parallelepiped. Again, the dielectric body 30 has a width W, a length l and a height H which may be 6.0 millimeters, 20.0 millimeters, and 8.8 millimeters, respectively. The dielectric body 30 is implemented as a homogeneous monolithic block of dielectric material. An input pin 31 and an output pin 32 each being made of a conductive material are disposed in the dielectric block 20 and extend to the upper end of the latter. A plurality of center conductors, three center conductors 33-1, 33-2 and 33-3 in the illustrative embodiment, are arranged substantially parallel to each other within the dielectric block 20, constituting dielectric resonators 34-1, 34-2 and 34-3. Conductive electrodes for frequency adjustment 35-1, 35-2 and 35-3 are arranged on one side of the dielectric body 30, and each extends across one end of respective one of the center conductors 33-1, 33-2 and 33-3. A metalized layer 36 is formed on the front and rear ends, right and left sides and bottom of the dielectric body 30 and is connected to ground. Electrodes 37 and 38 are positioned outwardly of the electrodes 35-1 and 35-3 with respect to the lengthwise direction of the dielectric body 30, serving to adjust the coupling capacitance.

The dielectric filter shown in FIGS. 3A to 3C is void of the conductive patterns 26-1 and 26-2 which have been shown and described in the previous embodiment as being respectively interposed between the first- and second-stage dielectric resonators 24-1 and 24-2 and between the second- and third-stage dielectric resonators 24-2 and 24-3.

Figure 4:
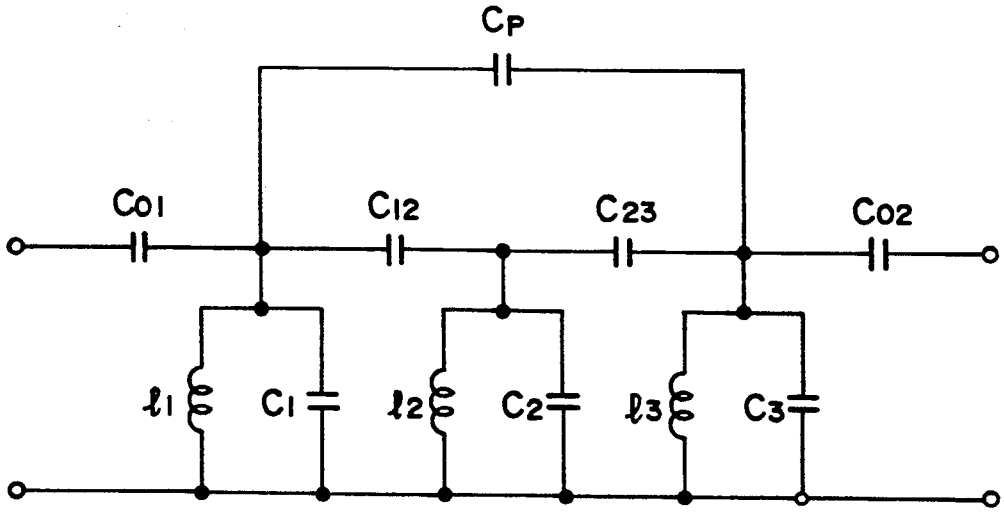
FIG. 4 is a diagram showing a lumped constant equivalent circuit associated with the embodiment of FIGS. 3A to 3C.

FIG. 4 shows an equivalent circuit representative of lumped constants which are included in the dielectric filter of FIGS. 3A to 3C. In FIG. 4, the equivalent LCs of the dielectric resonators 34-1, 34-2 and 34-3 are represented by ($l_1C_1$), ($l_2C_2$) and ($l_3C_3$), respectively. The coupling capacitance between the input pin 31 and the associated dielectric resonator 34-1 and the coupling capacitance between the output pin 32 and the associated dielectric resonator 34-3 are labeled $C_{01}$ and $C_{02}$, respectively. The coupling capacitance between the nearby dielectric resonators 34-1 and 34-2 through the dielectric is represented by $C_{12}$. Likewise, the coupling capacitance between the dielectric resonators 34-2 and 34-3 through the dielectric is represented by $C_{23}$. Further, the coupling capacitance between the dielectric resonators 34-1 and 34-3 through the dielectric is labeled $C_p$. Due to the coupling capacitance $C_p$, overcoupling occurs to produce a frequency $f\infty$ which provides infinite attenuation, i.e., an attenuation pole in the low-frequency attenuation range of the pass band. In this case, the frequency $f\infty$ providing infinite attenuation is produced by:

$$1/S=\{(1/C_p)+(1/C_{12})+(1/C_{23})+(C_0/C_{12}C_{23})\}+(1/S^3C_{12}C_{23}L_0)=0 \quad (3)$$

$$\omega\infty^2=1/L_0C_0\{C_{12}C_{23})/(C_0C_p)+(C_{23}/C_0)+(C_{12}/C_0)+1\} \quad (4)$$

It will be understood from the above equation (4) that the frequency $f\infty$ exists due to the existence of the coupling capacitance $C_p$ and occurs at the lower frequency side than the pass band.

The coupling capacitance $C_p$, like the coupling inductance $l_p$ stated in relation to the first embodiment, can be set at any desired value and adjusted with ease by changing the pitch or distance of the dielectric resonators 34-1, 34-2 and 34-3 or the configuration of the electrodes 35-1, 35-2 and 35-3.

Figure 5A:
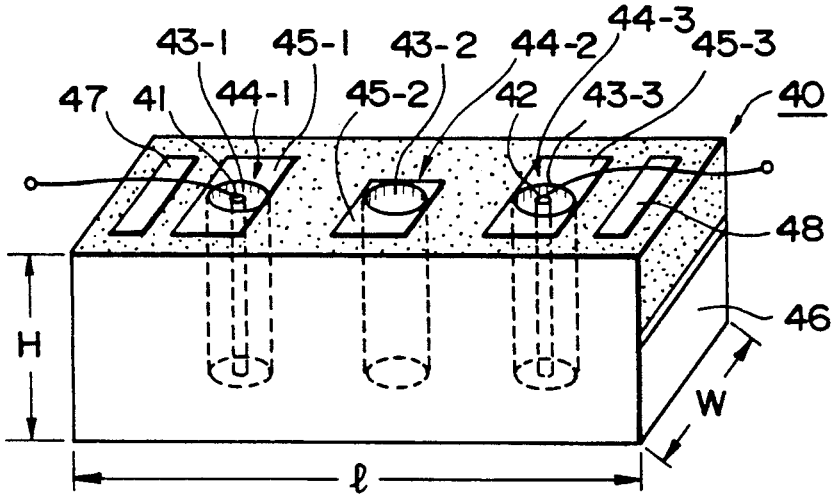
FIGS. 5A to 5C are views showing still another alternative embodiment of the present invention.
Figure 5B:
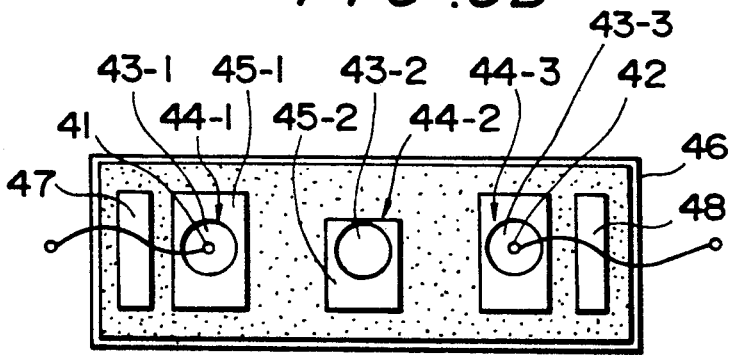
Figure 5C:
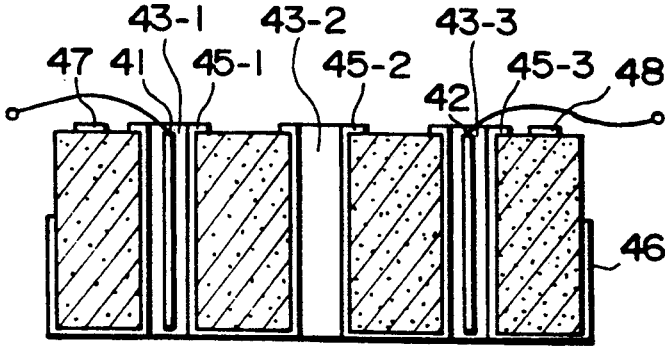

Referring to FIGS. 5A to 5C, another alternative embodiment of the present invention is shown which is also implemented as a three-stage dielectric filter. In this embodiment, the dielectric filter also has a homogeneous monolithic block of dielectric, i.e., dielectric body 40 which is configured in a rectangular parallelepiped. The dielectric body 40 has a width W, a length l and a height H which may be 6.0 millimeters, 20.0 millimeters and 8.8 millimeters, respectively. The dielectric filter has an input pin 41, an output pin 42, a plurality of, three in the illustrative embodiment, center conductors 43-1, 43-2 and 43-3, dielectric resonators 44-1, 44-2 and 44-3, a plurality of patterns 45-1, 45-2 an 45-3 adapted for frequency adjustment, a metalized layer 46, and patterns 47 and 48 for the adjustment of coupling capacitance. These structural parts and elements are constructed and arranged in the same manner as in the dielectric filter of FIGS. 1A to 1C.

The dielectric filter shown in FIGS. 5A to 5C differs from the dielectric filter of FIGS. 1A to 1C in that it achieves the overcoupling coupling inductance $l_p$ or the overcoupling coupling capacitance $C_p$ by changing the configuration of the electrodes instead of the pitch of the dielectric resonators.

Figure 6A:
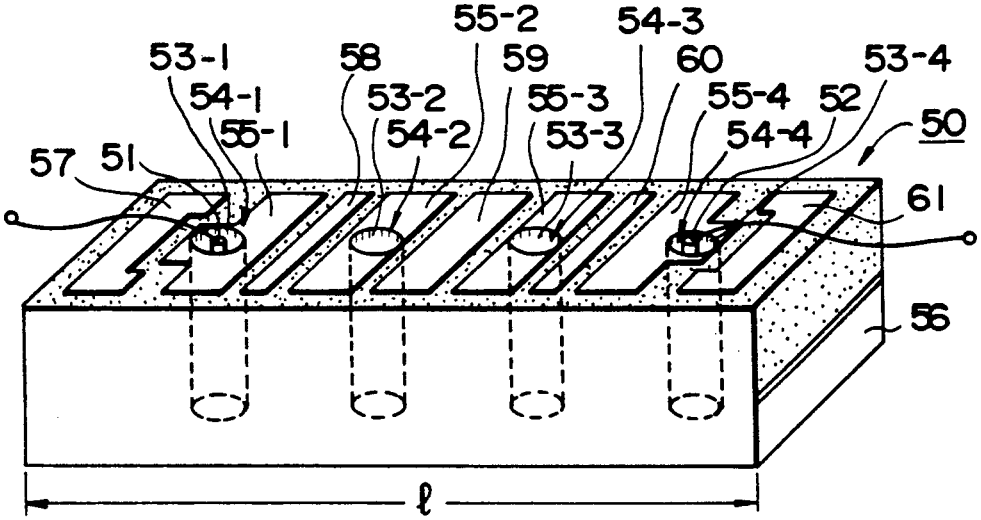
FIGS. 6A to 6C are views showing a further alternative embodiment of the present invention.
Figure 6B:
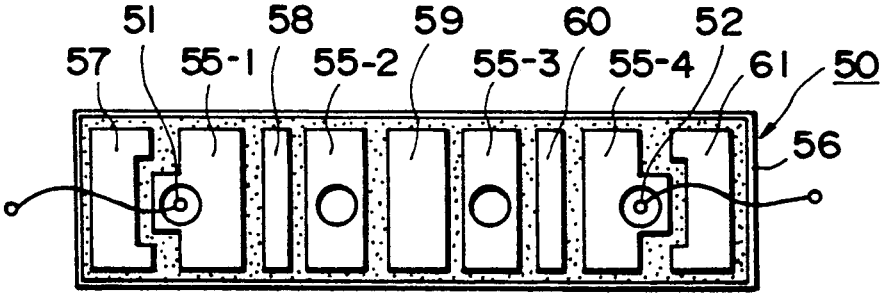
Figure 6C:
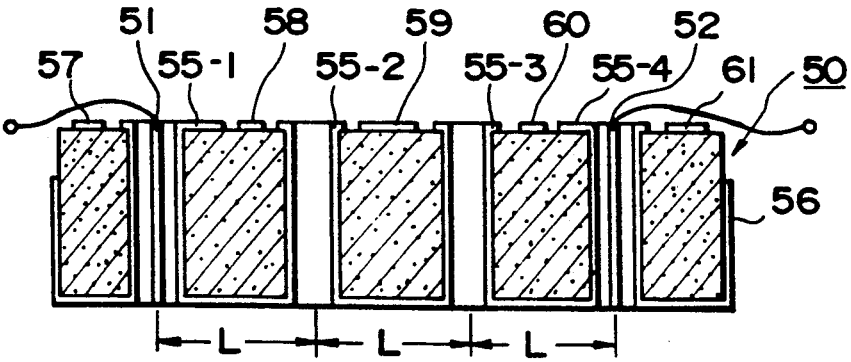

FIGS. 6A to 6C depict a further alternative embodiment of the present invention. In this particular embodiment, the dielectric filter has four elements disposed in a rectangular-parallelpiped monolithic block of dielectric 50. The dielectric filter accommodates an input pin 51, an output pin 52, a plurality of center conductors 54-1, 54-2, 54-3 and 54-4, a plurality of patterns for frequency adjustment 55-1, 55-2, 55-3 and 55-4, a metalized layer 56, and patterns for coupling capacitance adjustment 57, 58, 59, 60 and 61.

Figure 7:
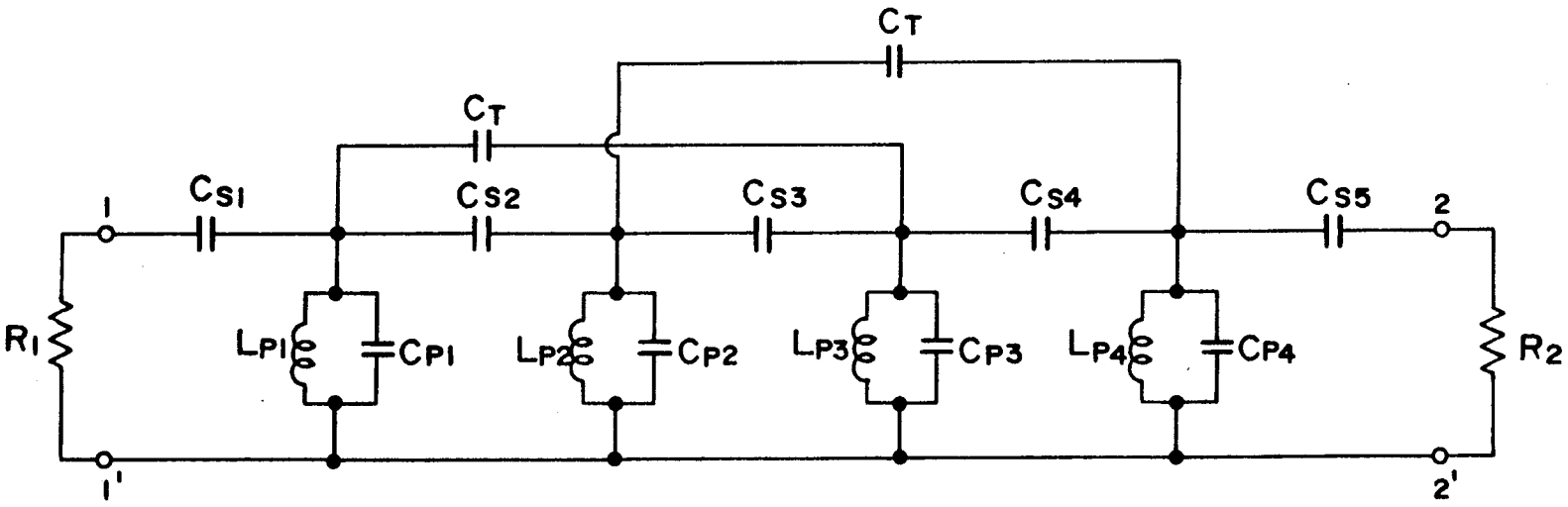
FIG. 7 is a diagram showing a lumped constant equivalent circuit associated with the embodiment of FIGS. 6A to 6C.

The lumped constants of the dielectric filter of the illustrative embodiment may be represented by an equivalent circuit shown in FIG. 7. In FIG. 7, the equivalent LCs of the dielectric resonators 54-1, 54-2, 54-3 and 54-4 are labeled ($L_{p1}C_{p1}$), ($L_{p2}C_{p2}$), ($L_{p3}C_{p3}$) and ($L_{p4}C_{p4}$), respectively. The coupling capacitance between the input pin 51 and the first or input-stage dielectric resonator 54-1 is represented by $C_{s1}$, the coupling capacitance between the output pin 52 and the fourth or output-stage dielectric resonator 54-4 by $C_{s5}$, the coupling capacitance between the first- and second-stage dielectric resonators 54-1 and 54-2 by $C_{s2}$, the coupling capacitance between the second- and third-stage dielectric resonators 54-2 and 54-3 by $C_{s3}$, and the coupling capacitance between the third-and fourth-stage dielectric resonators 54-3 and 54-4 by $C_{s4}$. The coupling capacitance between the first- and third-stage dielectric resonators 54-1 and 54-3 or the coupling capacitance between second- and fourth-stage dielectric resonators 54-2 and 54-4 is indicated by $C_\gamma$. Labeled $R_1$ and $R_2$ are a drive resistance and a terminal resistance, respectively.

The lumped constant equivalent circuit shown in FIG. 7 has an operation transmission coefficient $S_{B(s)}$ which is expressed as:

$$S_{B(S)}=\sum_{R=0}^{10} a_R S^R/S^7(S^2+\omega\infty^2) \quad (5)$$

where $$\omega\infty^2=C_T[(C_{s2}/L_{p3})+(C_{s4}/L_{p2})]/[(C_{s2}+C_{s3}+C_{s4})G^2+\{C_{s2}(C_{p3}+C_{s3}+C_{s4})+C_{s4}(C_{p2}+C_{s2}+C_{s3})\}C_T+C_{s2}C_{s3}C_{s4}] \quad (6)$$

Assuming $$L_{p3}(C_{p3}+C_{s3}+C_{s4})=1/\omega_0^2 L_{p2}(C_{p2}+C_{s2}+C_{s3})=1/\omega_0^2 \quad (7)$$

then the equation (6) is rewritten as:

$$\omega\infty^2/\omega_0^2=(L_{p2}C_{s2}+L_{p3}C_{s4})C_T/[\omega_0^2L_{p2}L_{p3}\{(C_{s2}+C_{s3}+C_{s4})\cdot C_T^2+C_{s2}C_{s3}C_{s4}\}+(L_{p2}C_{s2}+L_{p3}C_{s4})C_T] \quad (8)$$

Therefore, $$\omega\infty<\omega_0 \quad (9)$$

This shows that the frequency $f\infty$ which provides infinite attenuation lies in the lower frequency range than the center frequency $f_0$ of the pass band.

Based on the equation (8), the coupling capacitance $C_\gamma$ may be derived from $\omega\infty$, as follows:

$$C_\tau=\{-(R_2\omega\infty^2-R_4)\pm\sqrt{(R_2\omega\infty^2-R_4)^2-4R_1R_3\omega\infty^4}\}/2R_1\omega\infty^2 \quad (10)$$

where $$R_1=C_{s2}+C_{s3}+C_{s4}$$

$$R_2=C_{s2}(C_{p3}+C_{s3}+C_{s4})+C_{s4}(C_{p2}+C_{s2}+C_{s3})$$

$$R_3=C_{s2}C_{s3}C_{s4}$$

$$R_4=(C_{s2}/L_{p3})+(C_{s4}/L_{p2})$$

Figure 8:
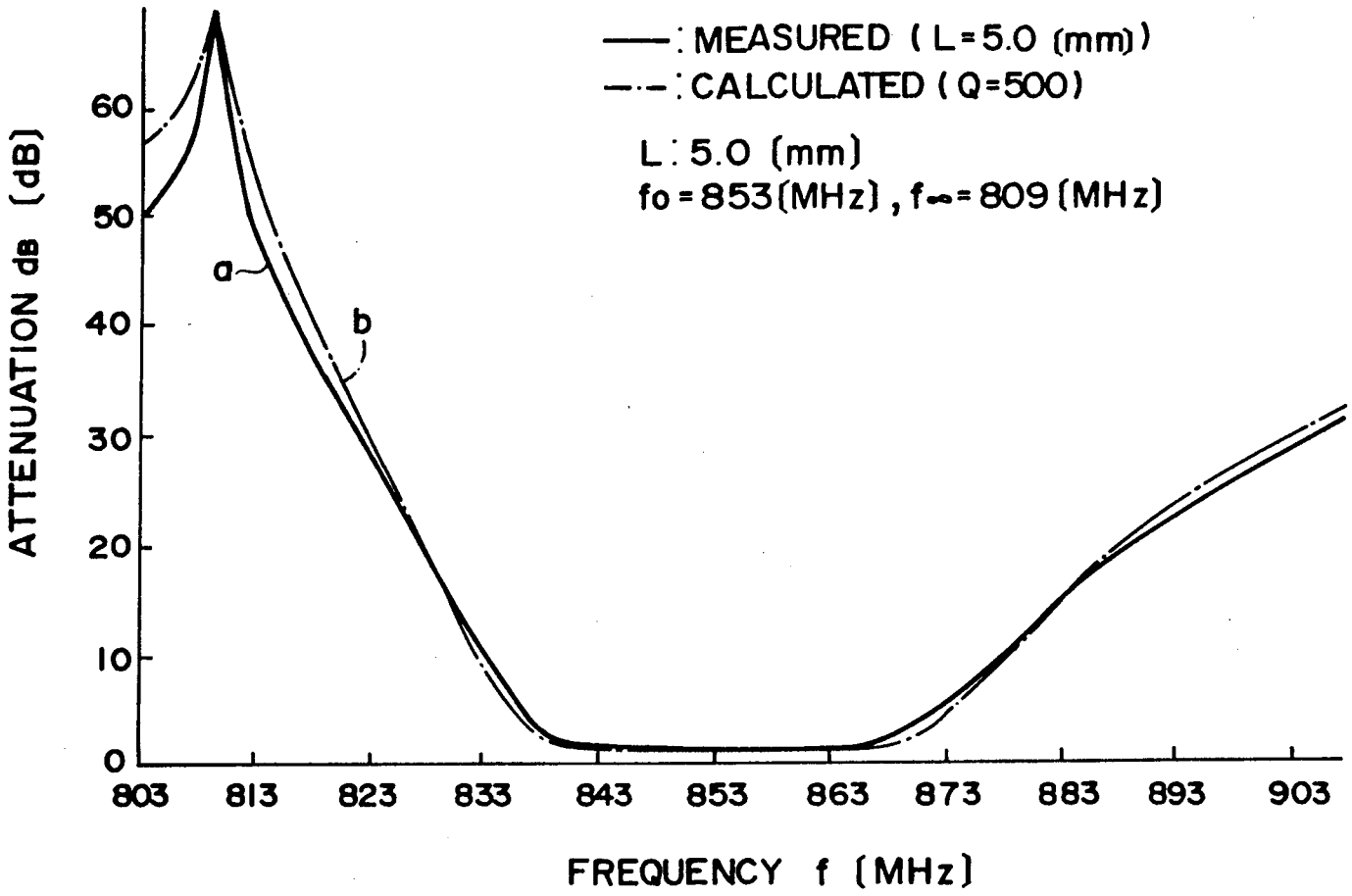
FIG. 8 is a graph showing a frequency to attenuation characteristic particular to the dielectric filter of FIGS. 6A to 6C.

The four-element type dielectric filter shown in FIG. 6 was experimentally fabricated with a resonator pitch L of 5.0 millimeters, frequency $f_0$ of 853 megahertz, frequency $f_{-c}$ of 840 megahertz, and frequency $f_{+c}$ of 866 megahertz. The frequency to attenuation characteristic measured with such a dielectric filter is represented by a curve a in FIG. 8. A curve b shown in FIG. 8 indicates a frequency to attenuation characteristic calculated with Q of 500. As shown, the actually measured characteristic is substantially coincident with the calculated characteristic.

Figure 9:
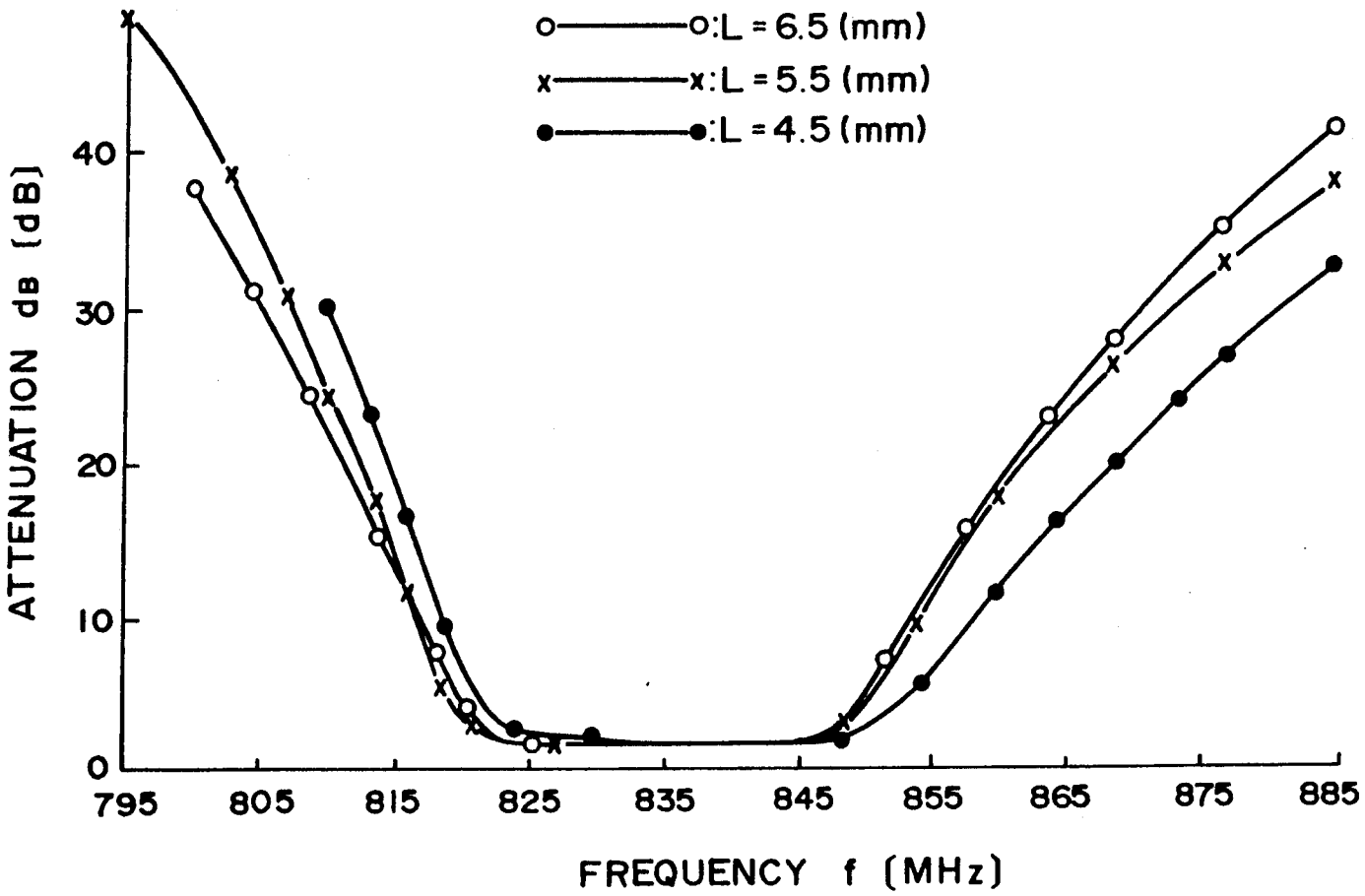
FIG. 9 is a graph showing a frequency to attenuation characteristic of the dielectric filter shown in FIGS. 6A to 6C with respect to some specific pitches.

FIG. 9 shows the results of measurement obtained with dielectric filters which were different in pitch L from each other. As shown, the position where the frequency $f_\infty$ occurs is dependent on the pitch L.

Figure 10:
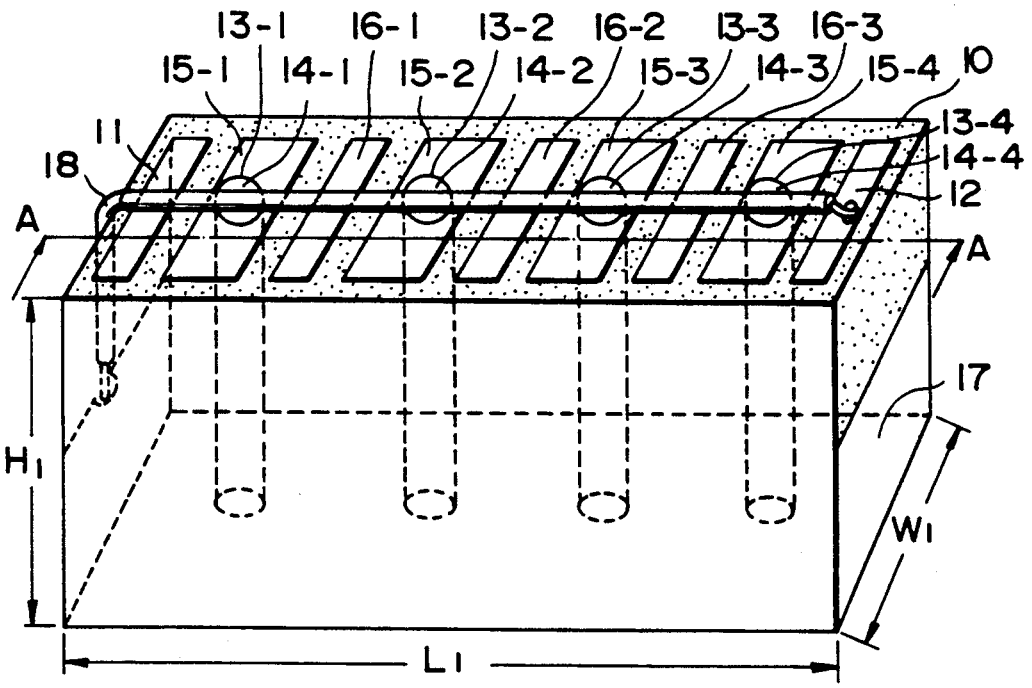
FIG. 10 RELATED ART
FIG. 10 is a perspective view of a dielectric filter of the type using an insulated wire.
Figure 11:
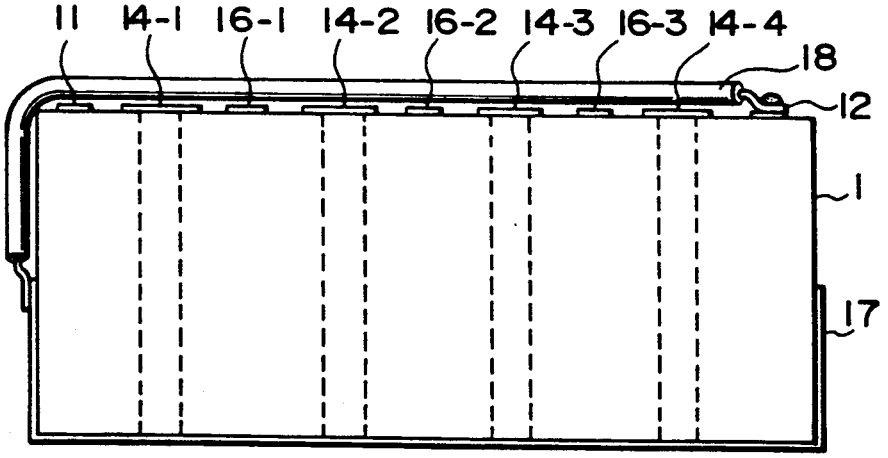
FIG. 11 RELATED ART
FIG. 11 is a section along line A—A of FIG. 10.
Figure 12:
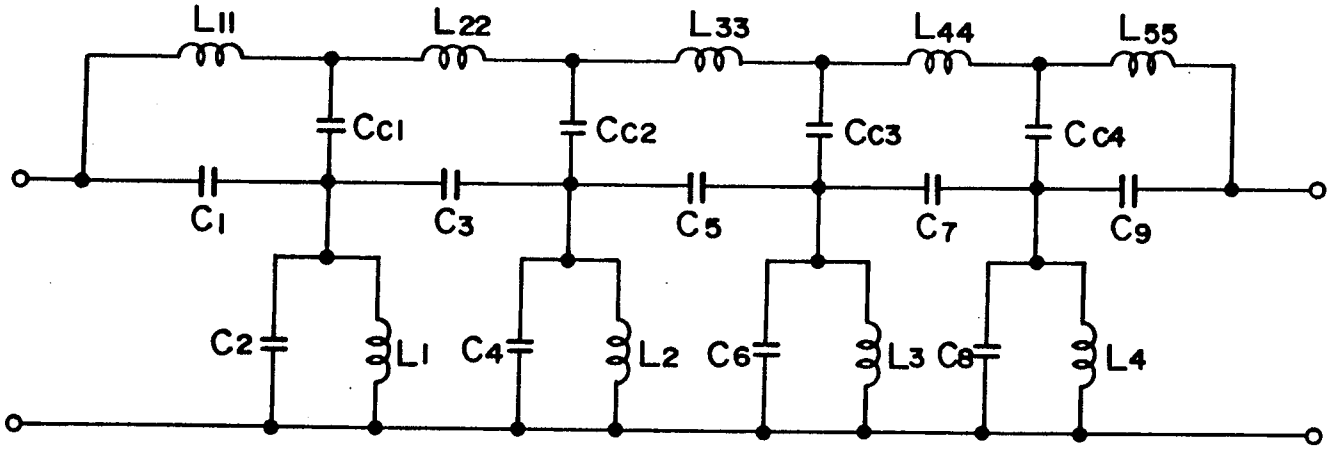
FIG. 12 RELATED ART
FIG. 12 is a diagram showing a lumped constant equivalent circuit representative of the dielectric filter shown in FIG. 10.

Referring to FIGS. 10 and 11, there is shown a specific construction of a dielectric filter of the type having an insulated wire extending over dielectric resonators. The illustrated dielectric filter construction is disclosed in Japanese Patent Laid-Open Publication No. 173904/1989 of the same applicant as the present application. Specifically, the dielectric filter has a dielectric block 10 which is provided with an input pattern 11, an output pattern 12, a plurality of center conductors 13-1, 13-2, 13-3 and 13-4, dielectric resonators 14-1, 14-2, 14-3 and 14-4, patterns 15-1, 15-2, 15-3 and 15-4 for frequency adjustment, and patterns 16-1, 16-2 and 16-3. A metalized pattern 17 is formed on the bottom and opposite sides of the dielectric block 10. An insulated wire 18 having an insulative coating is connected at one end to the metalized pattern 17. Extending over the dielectric resonators 14-1 to 14-4, the wire 18 is connected at the other end to the output pattern 12. FIG. 12 shows a lumped constant equivalent circuit associated with the dielectric filter of FIGS. 10 and 11. As the equivalent circuit indicates, a parallel resonance circuit is constituted by coupling constants $C_{C1}$, $C_{C2}$, $C_{C3}$ and $C_{C4}$ between the wire 18 and the dielectric resonators 14-1 to 14-4, self-inductances $L_{11}$, $L_{22}$, $L_{33}$, $L_{44}$ and $L_{55}$ of the wire 18, a coupling capacitance $C_1$ between the input pattern 11 and the dielectric resonator 14-1, a coupling capacitance $C_3$ between the dielectric resonators 14-1 and 14-2, a coupling capacitance $C_5$ between the dielectric resonators 14-2 and 14-3, a coupling capacitance $C_7$ between the dielectric resonators 14-3 and 14-4, and a coupling capacitance $C_9$ between the dielectric resonator 14-4 and the output pattern 12. Such a circuit is successful in setting up an attenuation pole.

However, with the insulated wire scheme discussed above, it is difficult to fix the wire 18 to the dielectric block 10 and, therefore, to set up an attenuation pole with accuracy. In contrast, any of the illustrative embodiments shown and described implements the attenuation pole by changing the distance between nearby dielectric resonators or the configuration of electrodes and not by using an insulated wire.

In summary, in accordance with the present invention, a frequency which provides infinite attenuation in either one of a higher and a lower attenuation range of a pass band is achievable on the basis of the distance between nearby dielectric resonators or the configuration of electrodes. This eliminates the need for an extra external circuit otherwise affixed to a dielectric filter. Hence, the present invention can satisfy even strict standards with a minimum of filter stages, thereby implementing a miniature, high performance and inexpensive dielectric filter.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A dielectric filter comprising:

a homogeneous monolithic block of dielectric material having opposite top and bottom surfaces, opposite front and rear surfaces and opposite left and right side surfaces, wherein said front and rear surfaces, lower portions of said left and right side surfaces adjacent to said bottom surface and said bottom surface are metalized;

first, second and third cylindrical resonators spaced apart from each other in a row in a left to right direction between said front and rear surfaces, each of said first, second and third cylindrical resonators extending in a top to bottom direction through said monolithic block;

a pair of first rectangular electrodes respectively extending lengthwise along said top surface in a front to rear direction of said monolithic block and respectively encompassing openings of said first and third cylindrical resonators, one of said pair of first rectangular electrodes extending lengthwise from said first cylindrical resonator to intermediate top surface portions of said monolithic block respectively located between said first cylindrical resonator and said front and rear surfaces, the other of said pair of first rectangular electrodes extending lengthwise from said third cylindrical resonator to intermediate top surface portions of said monolithic block respectively located between said third cylindrical resonator and said front and rear surfaces;

a second rectangular electrode encompassing an opening of said second cylindrical resonator and extending lengthwise along said top surface in the front to rear direction of said monolithic block between and spaced from said pair of first rectangular electrodes, said second electrode extending lengthwise from said second cylindrical resonator to an intermediate top surface portion of said monolithic block located between said second cylindrical resonator and one of said front and rear surfaces, said second rectangular electrode having substantially a same width as that of each of said pair of first rectangular electrodes and having a shorter length than that of each of said pair of first rectangular electrodes such that portions of said pair of first rectangular electrodes do not have said second rectangular electrode interposed therebetween;

a pair of third rectangular electrodes extending lengthwise along said top surface in the front to rear direction of said monolithic block, each of said pair of third rectangular electrodes having a substantially same length and a smaller width than each of said pair of first rectangular electrodes, wherein one of said pair of third rectangular electrodes is spaced from and located between said left side surface and said one of said pair of first rectangular electrodes, and the other of said pair of third rectangular electrodes is spaced from and located between said right side surface and said other of said pair of first rectangular electrodes; and input and output pins made of a conductive material and coaxially inserted respectively into said first and third cylindrical resonators;

wherein said shorter length of said second rectangular electrode permits a partial direct coupling between said pair of first rectangular electrodes for obtaining an overcoupling capacitance, and wherein said metalized portions of said left and right side surfaces and said pair of third rectangular electrodes are adapted for adjusting capacitive coupling.

* * * * *